US006038847A

United States Patent [19]

Jen

[11] Patent Number: 6,038,847

[45] Date of Patent: Mar. 21, 2000

[54] PROCESS FOR MANUFACTURING DIFFERENT SHRINKAGE MICROFIBER TEXTURE YARN

[75] Inventor: Zo-Chun Jen, Taipei, Taiwan

[73] Assignee: Nan Ya Plastics Corporation, Tapei, Taiwan

[21] Appl. No.: 09/140,894

[22] Filed: Aug. 27, 1998

[51] Int. Cl.[7] ..... D02G 1/16; D02G 1/18

[52] U.S. Cl. ..... 57/908; 57/289; 57/351; 28/258; 28/271

[58] Field of Search ..... 28/247, 271, 246, 28/258, 220, 240; 57/289, 333, 328, 908, 284, 285, 350, 351

[56] References Cited

U.S. PATENT DOCUMENTS

| | | | |
|---|---|---|---|
| 3,225,534 | 12/1965 | Knospe | 57/351 |
| 3,905,077 | 9/1975 | Frankfort et al. | 28/172 |
| 3,973,386 | 8/1976 | Gorrafa | 28/271 |
| 4,019,312 | 4/1977 | Warrick | 57/908 |
| 4,153,660 | 5/1979 | Reese | 28/271 |
| 4,292,799 | 10/1981 | Otaki et al. | 57/289 |
| 5,259,098 | 11/1993 | Gupta | 28/247 |
| 5,417,902 | 5/1995 | Bennie et al. | 57/289 |

*Primary Examiner*—Amy Vanatta
*Attorney, Agent, or Firm*—Bacon & Thomas

[57] ABSTRACT

A process for manufacturing different shrinkage micro-fiber texture yarn which uses a blend of micro-fiber yarn having a boil-off shrinkage lower than 10% and a low crimped filament having a boil-off shrinkage higher than 15%. The different shrinkage micro-fiber texture yarn is made by false twisting and drawing the micro-fiber, combining the micro-fiber with the low crimped filament and then intermingling the yarns together by using an air-tangling jet.

5 Claims, 2 Drawing Sheets

PROCESS FOR MANUFACTURING DIFFERENT SHRINKAGE MICROFIBER TEXTURE YARN

FIELD OF THE INVENTION

This invention relates to a process for producing a different shrinkage micro-fiber texture yarn, and in particular the invention is related to a different shrinkage micro-fiber texture yarn which is less than 0.5 dpf and is also related to a process for making the fabric which has improved feel such as softness and stiffness.

BACKGROUND OF THE INVENTION

Synthetic fiber has been prepared for commercial use for more than thirty years. Because consumer's taste changes rapidly and toward higher quality, producers of man-made fiber, have researched ways to provide a fabric with a natural appearance and which feels better than the natural fiber. For example, the popular peach-skin-like and suede-like fabrics have been produced with I dpf polyester fiber. The fabric made of 100% micro-fiber material will have excessive softness and inadequate anti-drape and fullness. Sometimes high twisted fiber may be added or the fabric constituent may be changed to overcome the excessive softness problem; but this increases the cost and reduce the fullness of the fabric. The objective of the invention is to solve the aforementioned problem by studying the different shrinkage production process of micro-fiber texture yarn. The invention places emphasis on the false-twist process and uses micro-fiber yarn as a low shrinkage yarn. Yarn with boil-off shrinkage less then 10% will be combined with a high shrinkage yarn, having boil-off shrinkage over 15%. These two yarns then be intermingled together during the texturing process.

After a weaving, dyeing and finishing process, heating the different shrinkage filaments causes production of the fabric with anti-drape and desired feel characteristic. It is different from that common use of high shrinkage yarn and low shrinkage yarn which are combined within a twister or air texturing process. The traditional process not only increases the cost, but also produces a product having inferior feel.

SUMMARY OF THE INVENTION

It is therefore an object of the present invention to provide a process for producing a different shrinkage micro-fiber texture yarn. A false-twist process is used which employs micro-fiber yarn as a low shrinkage yarn. This yarn with boil-off shrinkage less then 10% will be combined with a high shrinkage yarn, having boil-off shrinkage over 15%. These two yarns are then intermingled together during the texturing process.

Figure 1:
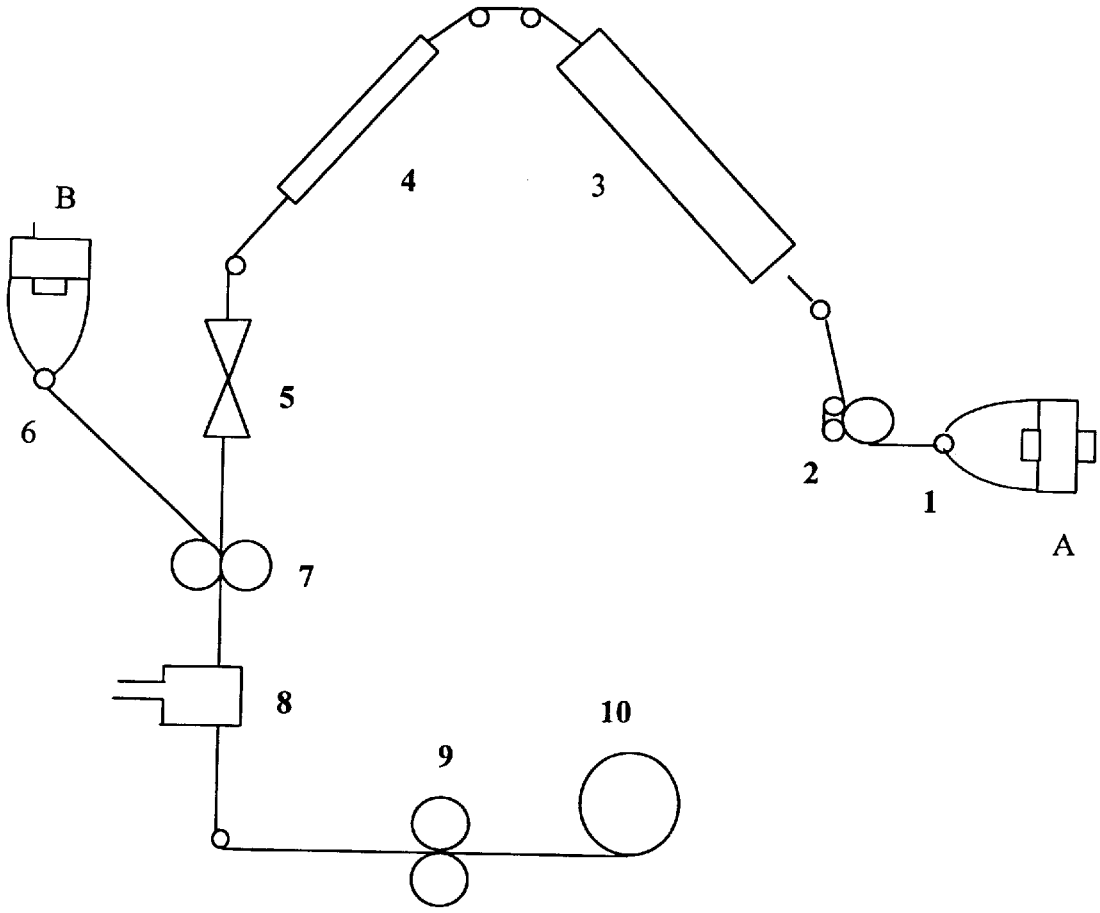
FIG. 1: Illustrates Process I of the invention for making different shrinkage of micro-fiber texture yarn.

The below listed letters and numerals have the following meaning in the drawings:

A: Micro-fiber yarn cake
B: High shrinkage yarn cake
1: First guide
2: First shaft
3: Heater
4: Cooling plate

5: Friction spindle unit
6: Second guide
7: Second shaft
8: Air jet
9: Third shaft
10: Take-up cylinder

DETAILED DESCRIPTION OF THE INVENTION

The primary purpose of this invention is to provide a process for producing a different shrinkage micro-fiber texture yarn. The process uses micro-fiber yarn as a low shrinkage yarn in a false twist process. This yarn with boil-off shrinkage less then 10% is combined with a high shrinkage yarn with boil-off shrinkage over 15%. These two yarns are then intermingled together during the texturing process.

The low shrinkage (lower than 10%) micro-fiber texture yarn used in this invention is conventional melt spun or conjugate spun yarn, which can be treated through a texturing process or dye-finish process to make the weight of per filament below 0.5 denier (gram per 9000 meter). A texture yarn lower than 0.5 dpf after drawn can be obtained with a conventional melt spinning device. The conjugate spinning process uses different polymer composite together, like polyester/polyamide, polyester/co-polyester (easily soluble polymer). After drawing and dye-finishing, these two different chemical components may be separated by mechanical or chemical separation to produce a micro-fiber texture yarn with dpf lower than 0.5 denier. The other yarn used in the invention is high shrinkage yarn with or without low torque. The high shrinkage yarns used in this invention have a boil-off shrinkage over 15%. For example, generally, polyethylene terephthalic is added with the third component isophthalic acid 5–35 mole percent or dimethyl 5-sulfoisophthalate sodium 1–10 mole percent, and the molecule crystallization of the chains are restrained during the production process to ensure the yarn have high shrinkage characteristic.

According to the above description, the shrinkage variant between two yarns must be over 10%. Namely, if the shrinkage of micro-fiber texture yarn is higher than 10% and the high shrinkage yarn is lower than 15%, the fabric which is made of the different shrinkage yarn compound can not attain the desired characteristics of softness and fullness. On the contrary, if the variance of shrinkage is higher than 50%, fabric would be over shrink, then softness and fullness also can not be obtained.

One manufacturing process of the invention is illustrated in FIG. 1. In this process a micro-fiber (A) passes through first guide (1), then to $1^{st}$ shaft (2), heater (3), cooling plate (4), friction device (5), and $2^{nd}$ shaft (7) before being intermingled with high shrinkage yarn (B) in the air tangling jet (8).

Figure 2:
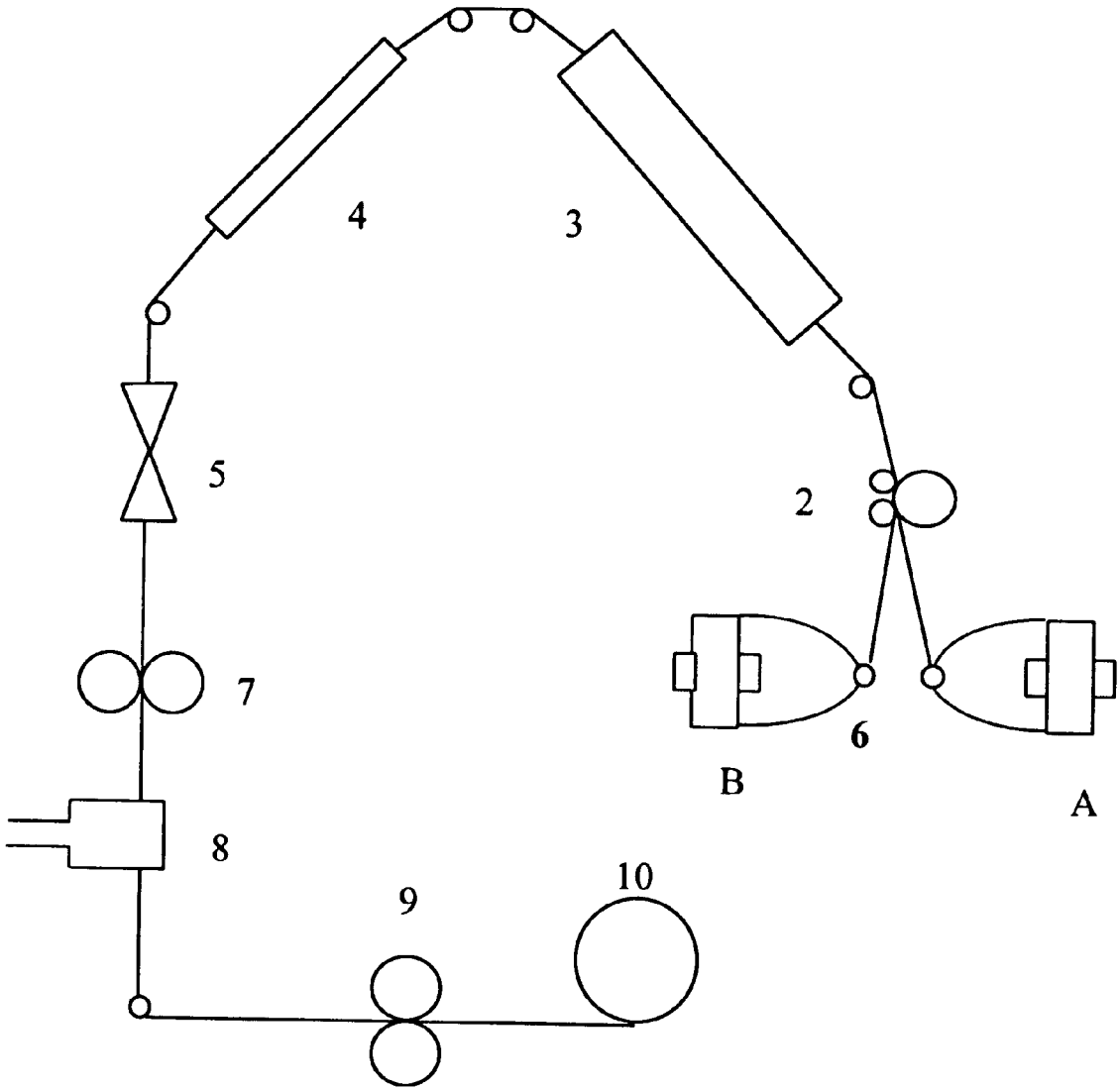
FIG. 2: Illustrates Process II of the invention for making different shrinkage of micro-fiber texture yarn.

Another manufacturing process of the invention is illustrated in FIG. 2 which uses a micro-fiber (A) in combination with high shrinkage yarn (B). Yarns (A) and (B) are unwound individually and then go through the guide (1) together, $1^{st}$ shaft (2), heater (3), cooling plate (4), friction device (5) and $2^{nd}$ shaft (7). The yarns are drafted and false-twisted between the $1^{st}$ and $2^{nd}$ shafts and and intermingling takes place between $2^{nd}$ and $3^{rd}$ shaft. Take-up of the product occurs in roller (10).

In the false-twisted texturing process mentioned above, the friction device (5) is not only limited to the disc type. Alternatively a belt type, or pin type friction device may be used. The air-tangling jet (8) is also a commonly used device which produces jets of flowing or mixing air. Generally, the air pressure should be above 2.0 kg/cm$^2$, preferably between 3.5–4.0 kg/cm$^2$. The number of entanglements should be over 100 entanglement per meter.

The boil-off shrinkage of this invention is analyzed as follows:

1. Clapping at the sample yarn head and loading with 0.1 gram per denier on the other end of sample yarn, and mark it at 100 centimeters place.

2. Packing the sample in the gauze then placing it in a water tank for 30 minutes with its temperature maintained at 100° C.

3. Taking the sample out of the tank, and then cooling with pure water and drying by pressing.

4. Tailing with 0.1 g/d load, reading the index "/"/ of mark.

5. Defining the boil-off shrinkage define by the following formula:

$$[(100-/)/\ /]\times 100\%]$$

EXAMPLE 1

A different shrinkage of $100^d/60^f$ micro-fiber texture yarn is manufactured by the process shown in FIG. 1. A $115^d/48^f$ polyester/polyarnide micro-fiber as yarn (A), is passed through the first guide (1) and $1^{st}$ shaft (2) to be heated with heater (3) at the temperature about 170° C. (100° C.–200° C.) and cooled in (4), and false-twisted in friction spindle unit (5) then passed to the $2^{nd}$ shaft (7) to be drawn with constant draw ratio of 1.7 (1.3–4.0). This provides a 6% boil-off shrinkage yarn which is then combined with a 45% high shrinkage yarn B of $30^d/12^f$, modified by isophthalic acid of 15 mole %. Both yarns enter the air jet, with 4.0 kg/cm$^2$ air pressure, and by the effect of air intermingling a good interlace is obtained between the $2^{nd}$ and the $3^{rd}$ shaft (9). The product is then taken up on the roller (10). The $2^{nd}$ shaft is set at a speed of about 50 to 400 m/min. By the above manufacturing process, a $100^d/60^f$ different shrinkage yarn of micro-fiber is obtained.

Using the $100^d/60^f$ different shrinkage micro-fiber texture yarn as the warp and a 150d/48f regular draw texture yarn as the weft, the woven fabric will be 25% of weight reduced by alkali solution. And then by rubbing, dyeing and finishing treatment, the surface of fabric will appear to be peach-skin like or moss-like with excellent fullness and soft texture.

EXAMPLE 2

A $225^d/84^f$ different shrinkage micro-fiber texture yarn manufactured by the process shown in FIG. 2. contains (A) which is a $210^d/48^f$ PET/CO-PET conjugate spun yarn, and (B) which is a $75^d/36^f$ modified by isophthalic acid (3 mole %), and has about 25% boil-off shrinkage. The two yarns separately go through guide 1(1) and second guide (6) and enter first shaft (2) together. They then go to heater (3) to be heated at the temperature about 125° C., then cooled by cooling plate (4), then through friction disc. then go to second shaft (7) where they are drawn at 400 m/min, 1.3 ratio, and thereby become two yarns with different shrinkage. Then by the effect of air intermingling in jet (8), a $225^d/84^f$ different shrinkage yarn of micro-fiber is obtained. Jet (8) which is located between the second shaft (7) and the third shaft (9) employs an air pressure of 3.6 kg/cm$^2$. The product is taken up on roller (10).

With the $225^d/84^f$ differential shrinkage micro-fiber texture yarn as the weft and a $75^d$/36f regular texture yarn as the warp, the woven fabric will be 30% weight reduced by alkali solution then through rubbing, dyeing and finishing treatment, fabric surface will present a leather-like appearance.

I claim:

1. A process for manufacturing different shrinkage micro-fiber texture yarn which comprises twisting and drawing micro-fiber yarn having a boil-off shrinkage lower than 20%; combining said micro-fiber with a low crimped filament yarn having a boil-off shrinkage higher than 15%; intermingling the two yarns together by using an air-tangling jet to thereby form said different shrinkage micro-fiber texture yarn.

2. The process of claim 1 wherein said micro-fiber yarn having a boil-off shrinkage lower than 10% is a filament made by a process which comprises melt spinning or conjugate spinning to form a fiber, drawing said fiber followed by the steps of false twisting and dyeing and then subjecting said dyed fiber to a finishing process to obtain a denier under 0.5 dpf.

3. The process of claim 1 which produces said different shrinkage micro-fiber texture yarn having a boil-off shrinkage variance between said micro-fiber yarn and said low crimped filament, which is from 10%–50%.

4. A process for manufacturing different shrinkage micro-fiber texture yarn which comprises false twisting a first yarn and a second yarn by feeding said first and second yarns into a false-twister and then intermingling said first and second yarns by using an air-tangling jet to thereby obtain said different shrinkage micro-fiber texture yarn; said first fiber being a micro-fiber yarn and said second yarn being a high boil-off shrinkage filament having shrinkage higher than 15%.

5. The process of claim 4 wherein the high boil-off shrinkage filament having shrinkage higher than 15% contains high shrinkage yarns of fully oriented yarn.

* * * * *